US005218263A

United States Patent [19]

Falce et al.

[11] Patent Number: 5,218,263

[45] Date of Patent: Jun. 8, 1993

[54] HIGH THERMAL EFFICIENCY DISPENSER-CATHODE AND METHOD OF MANUFACTURE THEREFOR

[75] Inventors: Louis R. Falce; Glenn S. Breeze, both of Lexington, Ky.

[73] Assignee: Ceradyne, Inc., Costa Mesa, Calif.

[21] Appl. No.: 742,363

[22] Filed: Aug. 8, 1991

Related U.S. Application Data

[63] Continuation-in-part of Ser. No. 588,213, Sep. 6, 1990, abandoned.

[51] Int. Cl.[5] ..... H01J 1/22; H01J 1/28/19/06; H01J 19/12

[52] U.S. Cl. ..... 313/270; 313/284; 313/292; 313/310; 313/326; 313/337; 313/346 DC; 313/346 R

[58] Field of Search ..... 313/346 DC, 238, 346 R, 313/283, 284, 292, 270, 337, 326, 310, 311, 312, 456

[56] References Cited

U.S. PATENT DOCUMENTS

| | | | |
|---|---|---|---|
| 3,551,727 | 12/1970 | Jensen et al. | 313/346 R |
| 4,101,800 | 7/1978 | Thomas et al. | 313/346 R X |
| 4,165,473 | 8/1979 | Falie | 313/346 R X |
| 4,417,173 | 11/1983 | Tuck et al. | 313/346 R |
| 4,823,044 | 4/1989 | Falie | 313/346 R X |
| 4,855,637 | 8/1989 | Watanabe et al. | 313/346 R |
| 5,030,879 | 7/1991 | Derks | 313/346 R |
| 5,041,757 | 8/1991 | Longo et al. | 313/346 DC |

*Primary Examiner*—Sandra L. O'Shea
*Assistant Examiner*—Ashok Patel
*Attorney, Agent, or Firm*—Leonard Tachner

[57] ABSTRACT

A reservoir dispenser cathode structure having improved thermal efficiency is provided by inner and outer subassemblies. The inner subassembly has a molybdenum heater cup to which a tungsten-rhenium alloy cap is laser seam-welded. The outer subassembly has a tantalum support cylinder within which the inner subassembly is supported by means of a three-point suspension in the form of tabs that are lanced from the tantalum cylinder and spot-welded to the heater cup. The heater has a coiled-coil design wherein the coils are coated with $Al_3O_3$ and small particle tungsten powder to increase the coil's thermal emissivity. This thermally-efficient structure permits the achievement of high current density (greater than 3 Amperes per square centimeter) with heater power that is less than 1.3 Watts.

26 Claims, 7 Drawing Sheets

HIGH THERMAL EFFICIENCY DISPENSER-CATHODE AND METHOD OF MANUFACTURE THEREFOR

CROSS- REFERENCE TO RELATED APPLICATIONS

This application is a continuation-in-part of application Ser. No. 07/588,213 filed Sep. 26, 1990, now abandoned.

BACKGROUND OF THE INVENTION

1. Field of the Invention

This invention pertains generally to thermionic cathodes and more particularly to reservoir-type dispenser cathodes which find particular advantageous application in cathode ray tubes that require relatively high current density.

2. Prior Art

The most relevant prior art known to the applicant is a co-inventor's previous patent, U.S. Pat. No. 4,823,044 issued Apr. 18, 1989 for A DISPENSER CATHODE AND METHOD OF MANUFACTURE THEREFORE. That patent discloses a dispenser cathode which employs a novel structure, permitting a significant reduction in cost for a cathode capable of achieving extremely high current densities, such as for use in cathode ray tubes. The structure of that dispenser cathode is conducive to a uniform level of performance throughout the life of the cathode, namely uniformity of current density. The configuration of that prior invention produces a uniform flow of barium from a reservoir enclosed pellet. The barium passes through a pure tungsten enclosing pellet which has a porous configuration. The porous, pure tungsten pellet needs no impregnation because the activating barium is derived entirely from the underlying enclosed pellet. The pure tungsten overlying pellet and the underlying barium source pellet configuration, prevents clogging of pores in the tungsten pellet and also prevents current density changes or patchiness, both instantaneously and over the life of the cathode. The prior art dispenser cathode of U.S. Pat. No. 4,823,044, comprises four separate pieces, namely a pressed and sintered porous tungsten pellet, a pressed pellet made of barium calcium aluminate and tungsten, a punched, pressed reservoir formed of molybdenum, rhenium, a combination molybdenum and rhenium, tantalum, or other refractory metal and a support cylinder in the form of an extrusion or similarly processed structure formed of molybdenum, molybdenum/-rhenium or tantalum. The resulting cathode is designed to operate at approximately 850–1,150 degrees centigrade, depending upon the current density objectives. The pellet contained within the reservoir provides a constant low level of barium evaporation to activate the tungsten in the overlying pellet.

The need for a high current density, relatively inexpensive cathode is driven by the demand for higher resolution cathode ray tubes for high definition television (HDTV), automotive displays, computer graphic displays, projection television and avionic applications. These new applications for cathode ray tubes require the employment of cathodes capable of producing higher current densities than those presently obtainable from the triple carbonate oxide cathode. In other than short pulse applications, the triple carbonate oxide cathode system, which has been the industry standard for decades, produces emission densities of less than an ampere per centimeter squared and therefore cannot be used in applications where higher densities are required A cathode system which will meet the market demand for higher resolution must be capable of achieving two design criteria. First, a smaller diameter electron beam bundle which produces a smaller spot size at the viewing surface is required. This smaller, electron beam is produced by using smaller apertures in the beam forming region (BFR) of the electron gun. Secondly, because brightness levels for these high resolution applications must be maintained, the currents of these smaller diameter electron beams must be the same as those of the conventional larger beam diameter systems. To achieve this goal, a cathode system must operate at a higher current density The characteristic behavior of an oxide cathode is related to the fact that it is essentially a dielectric material and will "charge up". It can only achieve high current densities in Short pulse length applications. Oxide cathodes are also susceptible to poisoning, requiring exacting and lengthy tube processing to obtain the best performance characteristics. The life of oxide cathodes and cathode ray tube guns is relatively short, particularly in applications where the current density is in excess of a few hundred milliAmperes per square centimeter. Because the dielectric nature of an oxide cathode limits the current density, a metal emitter as used in dispenser cathodes must be considered for cathode ray tubes.

The impregnated dispenser cathode, the most typical use of which is in microwave tubes, is made from porous tungsten which is impregnated with barium compounds. When heated, the barium compounds react with the tungsten matrix, allowing the barium to migrate to the surface of the cathode. Throughout its use, the cathode surface is constantly covered with barium and the emitter surface work function drops from 4.5 electron volts to as low as 2.0 electron volts. While the impregnated dispenser cathode is capable of producing high current densities and long lifetime use, it must be operated at about 200 degrees centigrade higher than the oxide cathode. In addition to requiring a higher operating temperature to produce the higher current density, this cathode also requires a longer activation cycle. These two performance characteristics result in excessive evaporation of the barium, which can cause unwanted grid emission and high voltage instability. Because of this and because the conventional impregnated dispenser cathode is more expensive to manufacture than the oxide cathode, the reservoir dispenser cathode was considered superior for use in cathode ray tube applications.

The reservoir cathode was the original type of dispenser cathode. With this design, barium compounds are held in a cavity or reservoir behind a porous disk, such as that disclosed in the aforementioned prior art patent of the applicant, namely U.S. Pat. No. 4,823,044. When heated, the compounds decompose or react with a reducing agent. The barium is then dispensed through the porous disk to the surface. While this novel reservoir cathode is a significant improvement over the previous art in terms of life and cost to manufacture, the porous disk through which the barium is dispensed, such as the tungsten overlying disk described in U.S. Pat. No. 4,823,044, has a porosity which is dependent upon the pressure, temperature and starting materials used in its fabrication. Furthermore, the number, size and location of the "pores" that are produced, such as for example by pressing and sintering pure tungsten, are random and relatively difficult to control. Consequently, the work function and life of each such prior art reservoir dispenser cathode may be somewhat unpredictable and vary from a maximum which may be otherwise attainable by careful control of the size, number and location of the pores through the overlying disk. Consequently, a need exists for improving the aforementioned reservoir dispenser cathode, by utilizing an emitter structure having a porosity which is not random, but which is geometrically controlled in a precise and predictable fashion, thereby permitting optimization of the various advantages previously derived from the invention disclosed in U.S. Pat. No. 4,823,044.

U.S Pat. No. 4,101,800 issued Jul. 18, 1978 relates to controlled porosity dispenser cathodes using metal foil made of a refractory metal and having selected holes made therein.

Another factor in considering a cathode for use in cathode ray tubes is its life expectancy. A long-life cathode is usually one which can operate at a reduced level of heater minimized work function permits lower operating temperature, but it is also highly desirable to have a high thermal efficiency structure which provides a commensurate reduction in heater power to produce the lower operating temperature. Inefficiency in the use of heater power to provide even a reduced operating temperature would be self-defeating. A cathode having high current density, controlled emitter porosity and long life expectancy due to a low operating temperature and an improved thermal efficiency structure, would indeed be desirable.

SUMMARY OF THE INVENTION

The present invention comprises a unique, controlled porosity, reservoir cathode which produces the higher current densities and brightness levels that are required in high-resolution cathode ray tube guns. Instead of using a porous tungsten disk for the emitter, in the present invention a refractory alloy metal sheet has been substituted therefor. The porosity of the metal sheet is not random as it is in the porous tungsten disk. Instead, the metal sheet of the present invention is provided with a precise array of holes or pores that are preferably laser-drilled in the refractory alloy emitter, directly behind the G1 aperture of the beam forming region of the electron gun. The size and spacing of the holes determine the dispensing rate of the barium from the underlying reservoir. Thus, evaporation rate is more precisely controlled. This results in a minimized work function which leads to a cathode which operates at a lower temperature thereby increasing lifetime and consistently producing higher current density.

In one embodiment of the present invention, the structure of the cathode is similar to that disclosed in the aforementioned prior patent of the present applicant, except that the porous tungsten disk thereof which forms the overlying pellet through which the barium passes, is replaced by a 50 micrometer thickness sheet of a tungsten-rhenium alloy in which the rhenium constitutes about 10–50 percent of the total volume. In a typical high current density embodiment, the laser-drilled holes are 5 micrometers in diameter and arranged on 15 micrometer spaced centers. The hole spacing may be varied to accommodate desired changes in current density and barium migration characteristics. The holes are laser-drilled on a numerically controlled apparatus, having a motion precision of one micrometer, while using a YAG eodymium doped, pulsed laser. The laser-drilled metal sheet is subsequently laser welded to the reservoir container, which in turn, holds a selected quantity of tungsten and barium calcium aluminate. Scandium oxide may also be part of the emissive material within the reservoir. The reservoir, the tungsten and barium calcium aluminate which it contains and the overlying laser-drilled metal sheet, are, in turn, retained in a refractory cylindrical tube into which a heater is placed immediately behind the reservoir to heat the mixture of tungsten and barium calcium aluminate. Upon heating of the mixture, barium is dispensed through the precisely drilled holes of the overlying laser-drilled metal sheet. Because the holes drilled through the tungsten-rhenium alloy metal sheet are of precise diameter, position and density, the work function thereof may be minimized, thereby maximizing the electron emission and the current density, while maintaining constant performance the invention. Furthermore, and more importantly, the precise, selected hole size, location and frequency, avoids the randomness of the porous tungsten pellet of the applicant's prior invention, thereby assuring virtually optimum cathode performance in every case.

The preferred embodiment of the invention also provides a thermally high-efficiency structure to fully exploit the performance of the cathode in a long-life configuration in which the ratio of heater power to current density is very low. This long-life configuration comprises two subassemblies, namely, an inner subassembly and an outer subassembly. The inner subassembly comprises a laser-drilled tungsten-rhenium alloy cap which is laser seam-welded to a molybdenum heater cup. The welding of the cap to the cup assures excellent heat transfer from the heater cup to the electron emissive surface of the cathode A pellet containing barium compound is captured between the cap and the heater cup to provide a long-life supply of barium to the cathode surface. The molybdenum heater cup allows good heat transfer from the heater coils within, while providing a moderately low thermal emissivity to reduce outside surface radiation losses. Further radiation loss reduction is accomplished by limiting the total outside surface area of the subassembly. The heater is a coiled-coil design which incorporates the maximum amount of wire mass in the provided cup volume. The outside of the tungsten-rhenium heater coils are alumina coated with a second thinner outer layer coating of a small particle size tungsten powder or "dark" coating to increase the thermal emissivity of the coil surface. The outer subassembly of the cathode of the present invention utilizes a three-point suspension of the inner subassembly by attachment to tabs which are lanced from the seamless tantalum tubing of the outer subassembly. The tabs are resistance spot-welded to the molybdenum heater cup. The tantalum provides a moderately poor thermal conductor which reduces the power loss to the support structure.

The inverted tab structure provides a rigid mechanical support for the inner cathode assembly and thermally isolates the inner subassembly from the outer subassembly. The heat transfer from the tabs is in a direction of higher temperature which is due to the close proximity of the outer support cylinder and thus reduces the tab thermal loss. At the same time, the outer support cylinder of the outer subassembly acts as a reflective heat shield to "blanket" the inner subassembly. As a result of these various structurally advantageous improvements in regard to the thermal efficiency of the cathode of the present invention, the ratio of heater power to operating temperature is significantly reduced, thereby rendering it possible to provide an extremely high current density cathode while supplying significantly lower power to the heater and thus prolonging the life of the cathode.

OBJECTS OF THE INVENTION

It is therefore a principal object of the present invention to provide a controlled porosity, high thermal efficiency reservoir dispenser cathode which assures long-life optimum high current density performance as compared to the applicant's prior art invention in which random variation in the porosity of a sintered porous tungsten pellet, permits commensurate variations in the performance of the cathode therein.

It is an additional object of the present invention to provide a controlled porosity, high thermal efficiency reservoir dispenser cathode which provides a low cost, high current density, long lifetime cathode, especially adapted for use in cathode ray tubes for applications such as high definition TV and the like, the cathode comprising a reservoir filled with tungsten and barium calcium aluminate and having at least one surface covered by a laser-drilled tungsten alloy metal sheet, having precisely selected holes drilled therein to optimize current density performance characteristics therein, without any significant variation from cathode to cathode.

It is still an additional object of the present invention to provide an improved reservoir dispenser cathode of the type disclosed previously in U.S. Pat. No. 4,823,044 but with a uniquely configured, thermally efficient structure and wherein the porous tungsten pellet thereof is replaced by a controlled porosity refractory alloy metal sheet providing a precise array of drilled holes of selected size and spacing which determine the dispensing rate of barium in an underlying reservoir filled with barium calcium aluminate and tungsten, thereby controlling the evaporation rate and optimizing current density, operating temperature and lifetime.

It is still an additional object of the present invention to provide an improved reservoir dispenser cathode with a uniquely configured, thermally efficient structure, wherein the structure comprises an inner subassembly and an outer subassembly, the inner subassembly being thermally isolated from the outer subassembly by means of a multipoint suspension configuration.

It is still an additional object of the present invention to provide an improved reservoir dispenser cathode with a uniquely configured thermally efficient structure comprising thermally isolated inner and outer subassemblies in which the outer subassembly comprises a support cylinder which acts as a reflective shield to "blanket" the inner subassembly.

BRIEF DESCRIPTION OF THE DRAWINGS

The aforementioned objects and advantages of the present invention, as well as additional objects and advantages thereof, will be more fully understood hereinafter, as a result of a detailed description of a preferred embodiment when taken in conjunction with the following drawings in which.

DETAILED DESCRIPTION OF PREFERRED EMBODIMENTS

Figure 1:
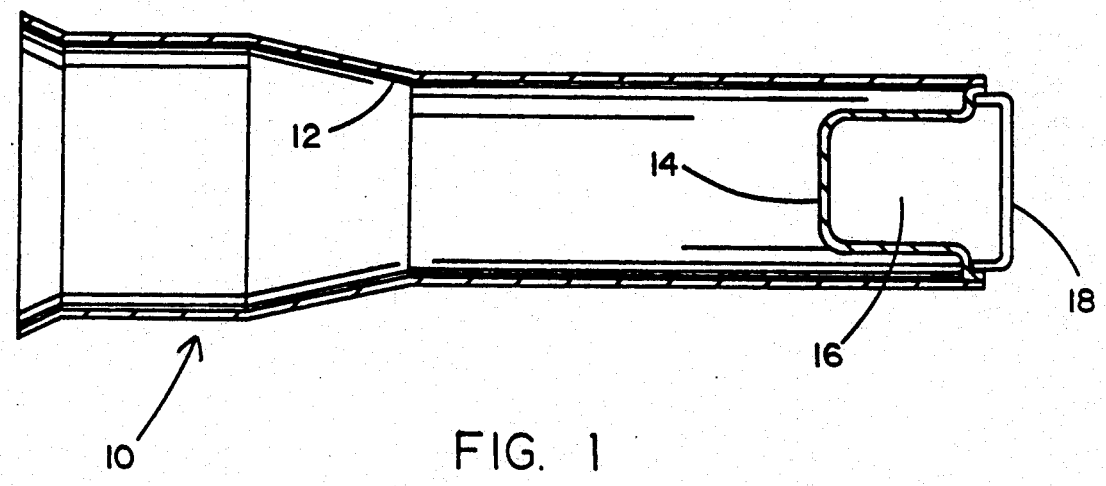
FIG. 1 is a cross-sectional view of a first embodiment of the cathode assembly of the present invention.

Referring first to FIG. 1, it will be seen that one embodiment of the cathode assembly 10 of the present invention comprises a support cylinder 12, a reservoir 14 containing an emissive material 16 and capped or enclosed by a porous plate 18. Support cylinder 12 is preferably formed of a refractory metal material, such as antalum, molybdenum, rhenium, molybdenum-rhenium, tungsten, tungsten-rhenium or tantalum and may be provided by extrusion or similar process. One end of the support cylinder 12 is flared to facilitate insertion of a heater element which is positioned immediately behind and in contact with the reservoir 14, which is positioned at the opposite end of support cylinder 12. Reservoir 14 is also of a generally cylindrical configuration and is also formed of a refractory metal such as molybdenum, rhenium, molybdenum-rhenium, tantalum, tungsten, tungsten-rhenium or other refractory metal.

Emissive material 16 is in a preferred embodiment of the invention, comprised of a mixture of barium calcium aluminate and tungsten, wherein tungsten constitutes 20 to 50 percent of the mixture.

The overlying porous plate 18, in a preferred embodiment of the invention, comprises tungsten-rhenium and is of a generally planar configuration along a majority of its surface area. It preferably comprises tungsten-rhenium where rhenium constitutes 10 to 50 percent of the overall combination in the alloy. The data shown in FIGS. 3 to 6 are for a 25 percent rhenium −75 percent tungsten alloy.

Figure 2:
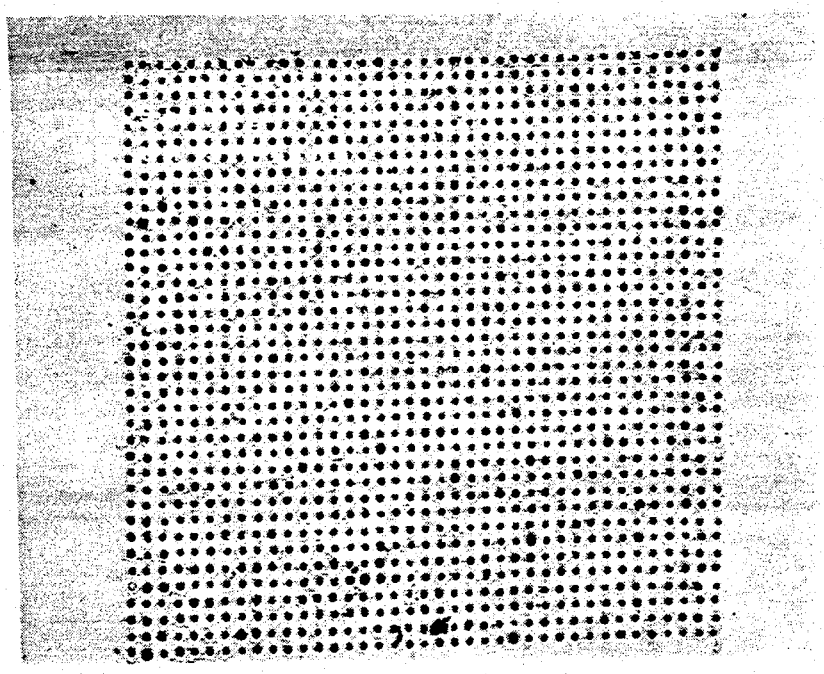
FIG. 2 is a photomicrograph of a laser-drilled, refractory metal sheet in accordance with the present invention.

FIG. 2 illustrates a scanning electron micrograph of the emission surface of the cathode 14, along which porous plate 18 is visible. It illustrates that porous plate 18 is generally circular and has a region of square shape which comprises a large plurality of equidistantly spaced holes of generally circular configuration. Each such pore or hole is approximately 5 microns in diameter and is spaced 15 microns from adjacent holes measuring center-to-center. Plate 18 is preferably a planar plate, particularly at the area in which the pores are drilled. The plate is approximately 50 microns in thickness. In a preferred embodiment of the invention, the pores or holes through the central square region of porous plate 18 are made by a laser drilling process, using a computer controlled XY table having a precision of at least one micron in increments of movement in the X and Y planes, respectively and positioned beneath a stationary YAG neodymium doped, pulsed laser.

It will be seen in FIGS. 1 and 2 that the design of porous plate 18 renders each cathode substantially uniform in structure, even considering the precise size and position of the pore holes through plate 18. This is the most significant distinction between the present invention and the invention disclosed in the applicant's previous U.S. Pat. No. 4,823,044. Unlike the overlying pellet shown therein, which as disclosed in that patent comprises a pressed and sintered porous tungsten pellet of 70–80 percent density, made from powder in the range of 4–7 microns in diameter, the pores in porous plate 18 of the present invention are all selected to have precise size, location and density, thereby assuring optimum cathode performance without any substantial variation that might otherwise occur given the random porosity of a pressed and sintered tungsten pellet.

Figure 4:
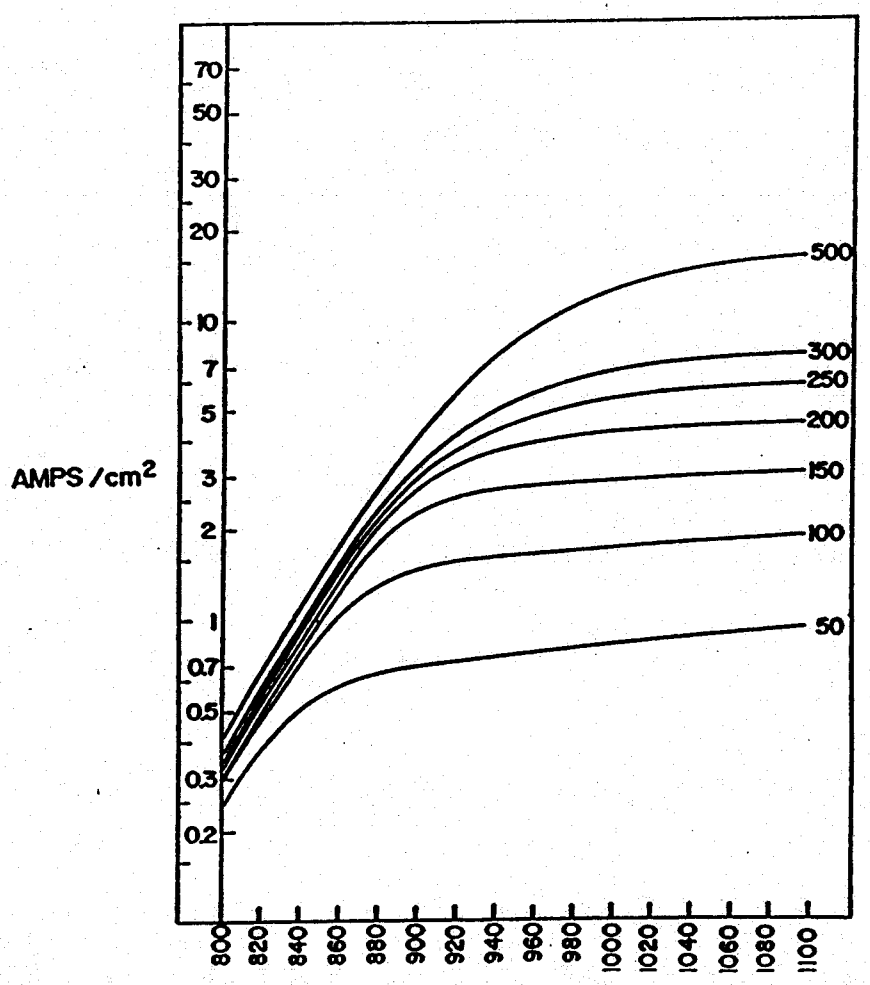
FIG. 4 is a graphical representation of current density versus temperature for the cathode of the present invention.
Figure 3:
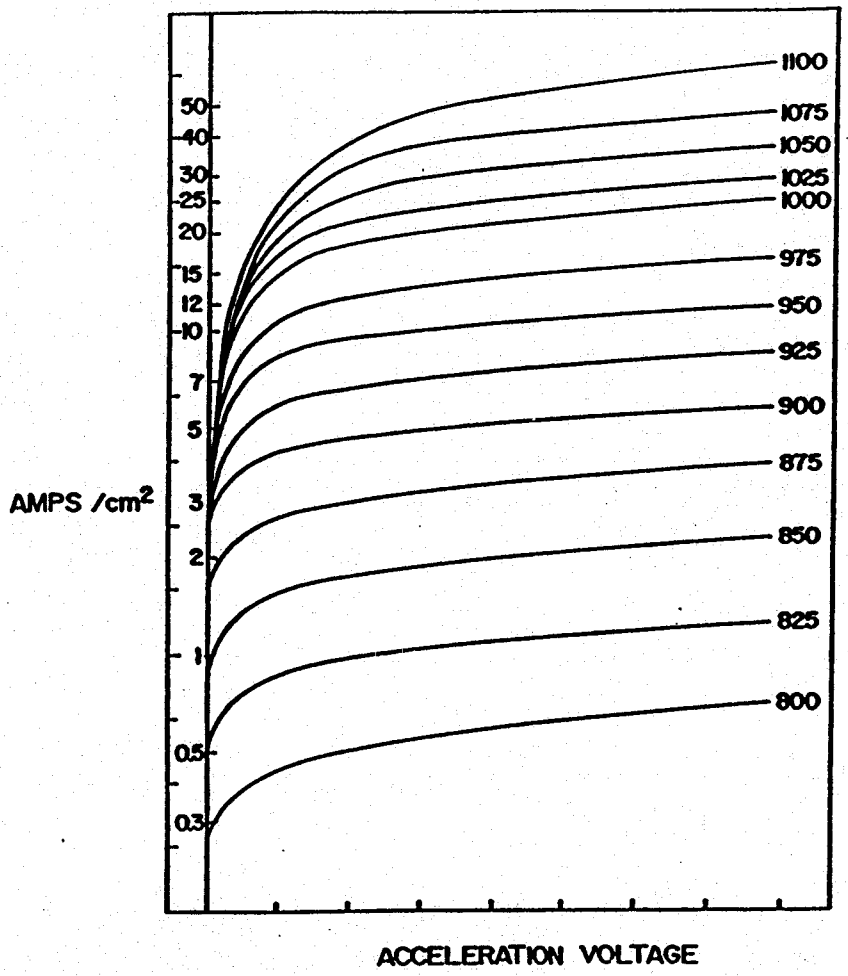
FIG. 3 is a graphical representation of current density versus the square root of voltage for a CRT cathode in accordance with the present invention.
Figure 5:
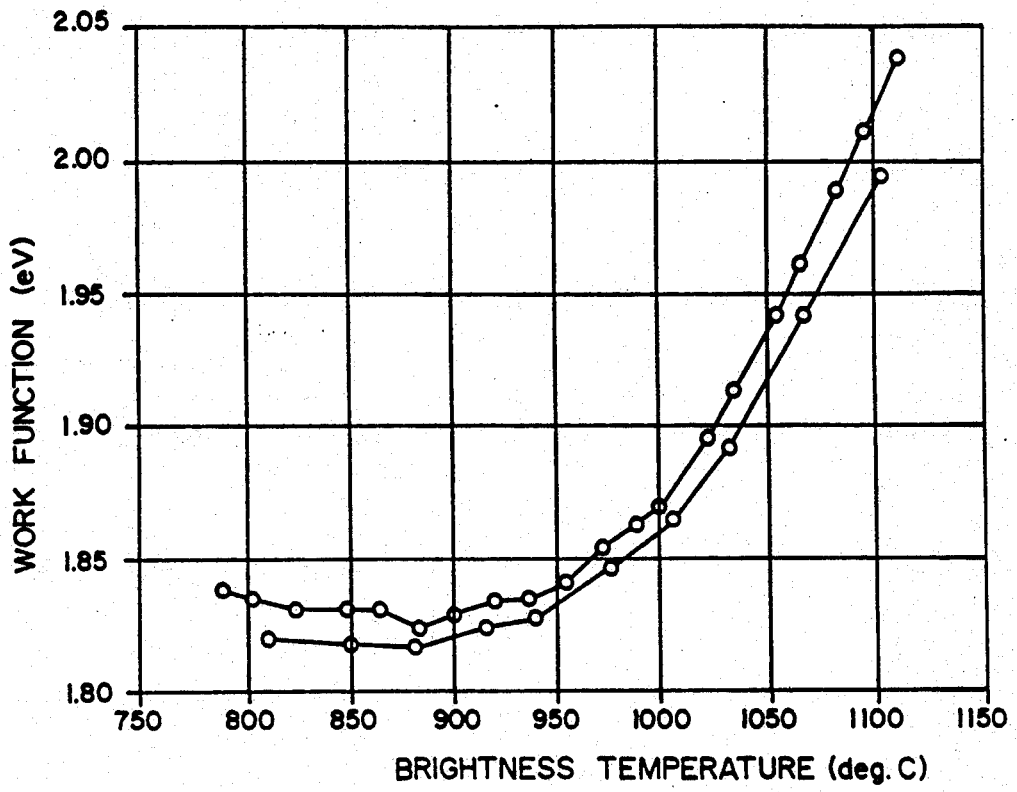
FIG. 5 is a graphical representation of work function versus brightness temperature for a cathode of the present invention.
Figure 6:
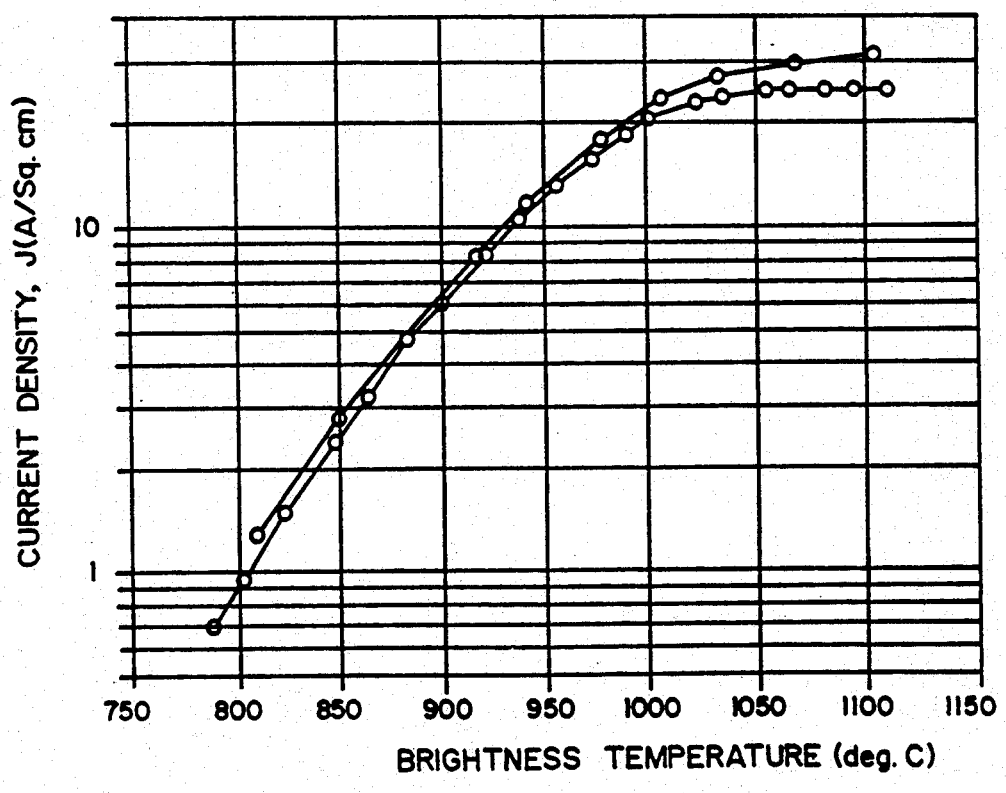
FIG. 6 is a graphical representation of current density versus brightness temperature for the cathode of the present invention.
Figure 7:
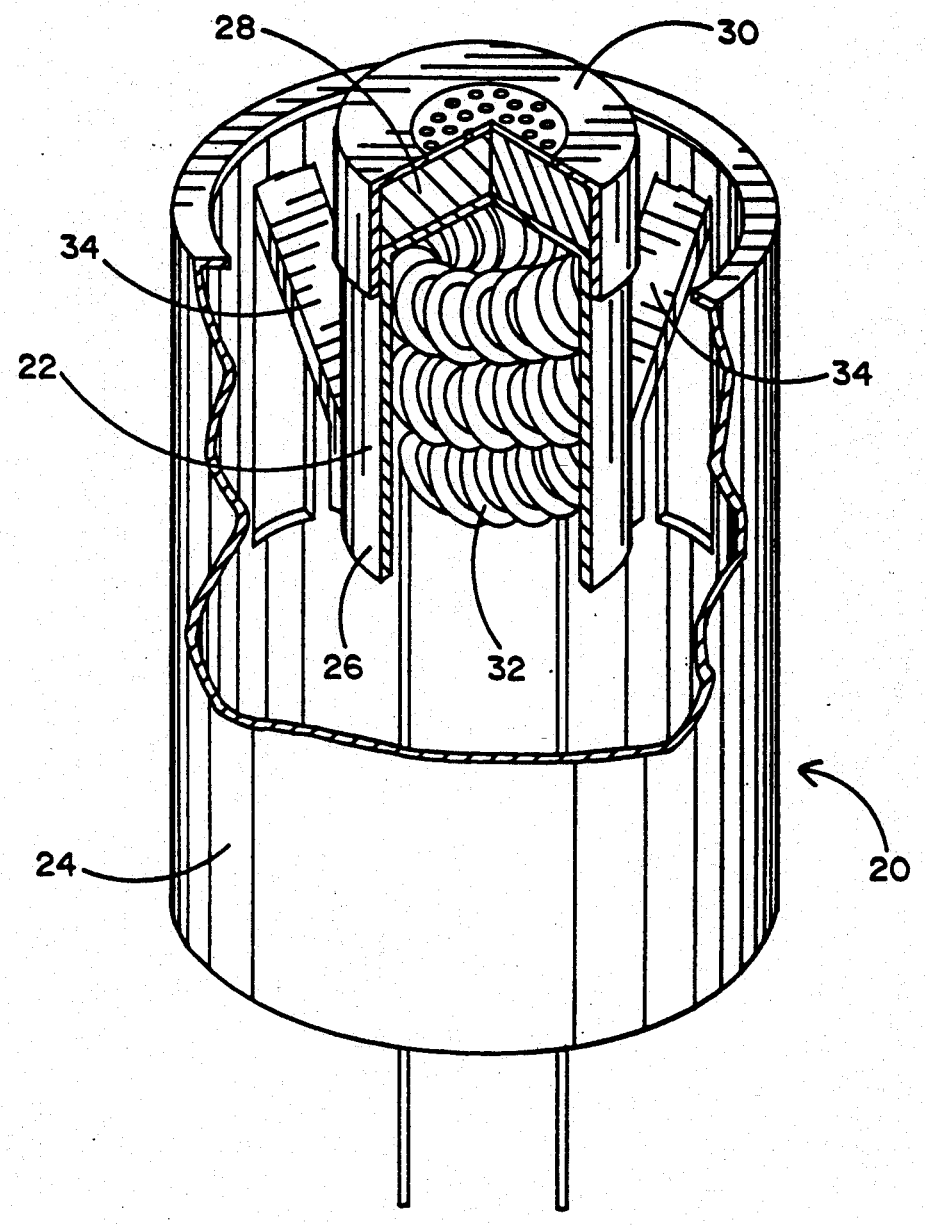
FIG. 7 is an enlarged, partially cut-away, isometric view of a second embodiment of the invention.
Figure 8:
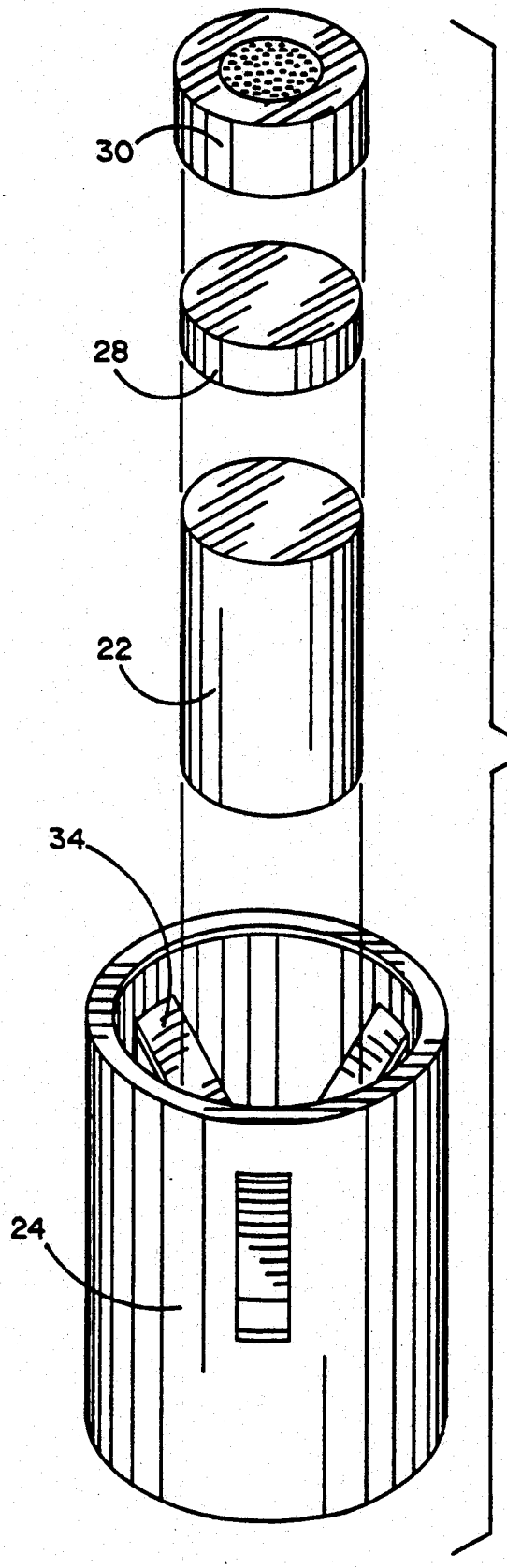
FIG. 8 is an exploded view of the component parts of the second embodiment.
Figure 9:
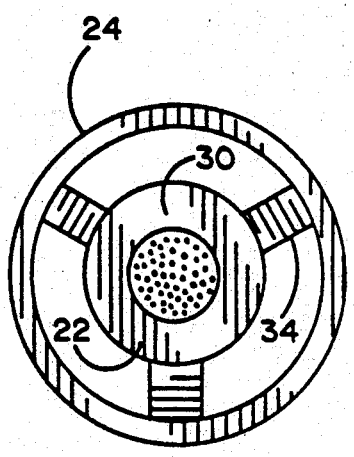
FIG. 9 is a top view of the second embodiment.
Figure 10:
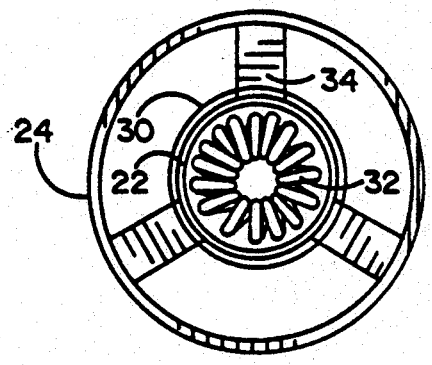
FIG. 10 is a bottom view of the second embodiment.
Figure 11:
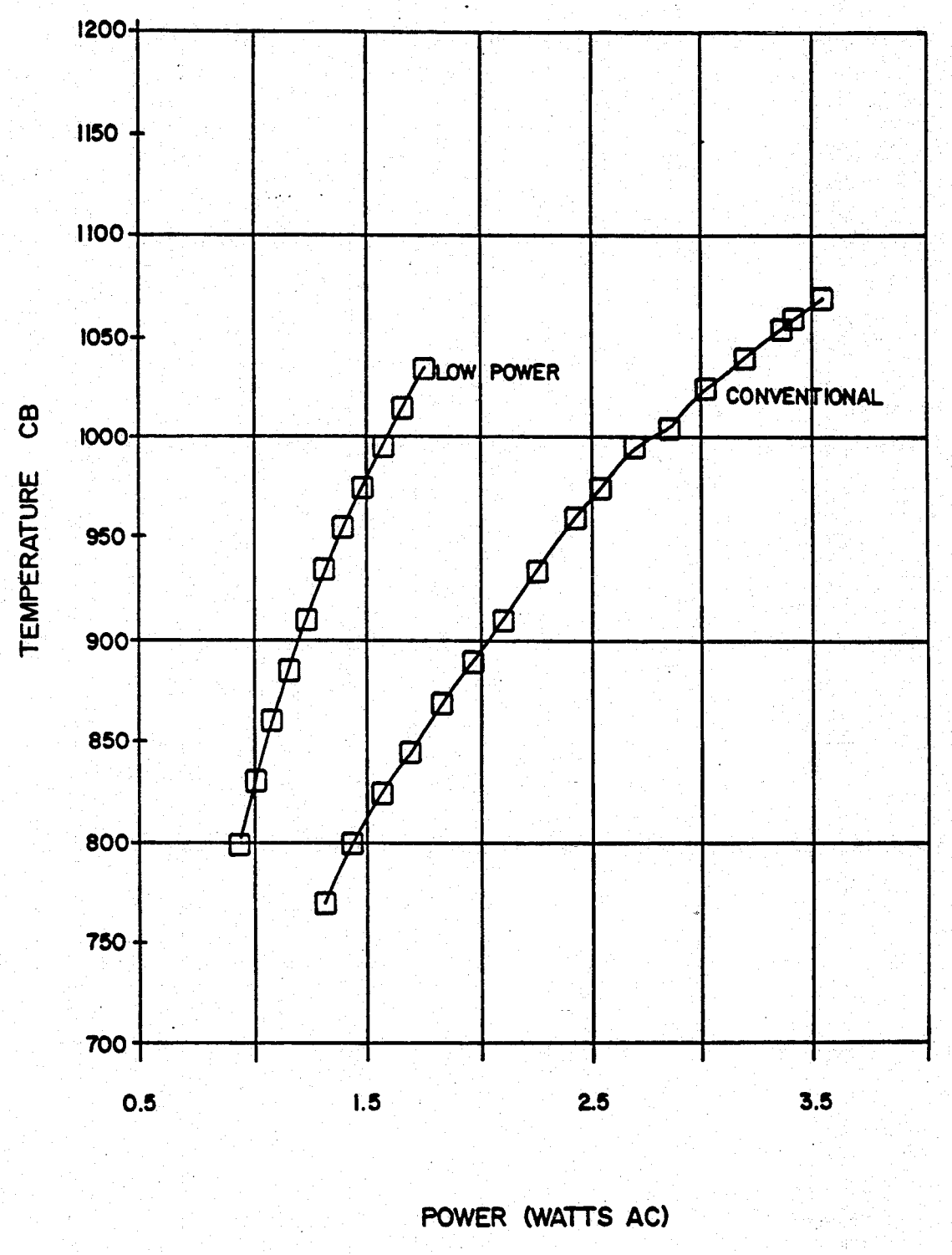
FIG. 11 is a graphical representation of heater power-versus heater temperature for the second embodiment and a conventional thermal structure.

The performance of the cathode of the present invention may be best understood by referring to FIGS. 3–6. FIG. 3 provides a graph of current density versus the square root of voltage for the cathode of the present invention. Such graphs are commonly referred to in the cathode art as Schottky plots. As shown therein, at 1100 degrees centigrade Br, J is almost 50 Amperes per square centimeter and even at a temperature as low as 875 degrees centigrade Br, J is 3 amperes per square centimeter. FIG. 4 is a graph of data from close-spaced diode testing showing current density versus temperature at various acceleration voltages. FIG. 5 is a graphical illustration of work function versus temperature in the present invention and FIG. 6 is a graphical presentation of current density versus temperature in the cathode of the present invention. The graphs of FIGS. 5 and 6 both contain two plots of data taken on separate occasions. FIG. 5 illustrates that the present invention exhibits a work function of less than 2.05 at 1100 degrees centigrade and provides a current density of between 25 and 32 Amps per square centimeter at the same temperature. The data of FIG. 6 also illustrates that if only 10 amps per square centimeter current density is required, such current density may be provided by the present invention at a temperature less than 950 degrees centigrade, which corresponds to a temperature region at which the work function of the present invention is less than 1.85.

Referring now to FIGS. 7 to 11 it will be seen that in a second, preferred embodiment 20 of the cathode of the present invention, the cathode structure comprises two distinctive subassemblies, namely, an inner subassembly 22 and an outer subassembly 24. The inner subassembly 22 comprises a molybdenum heater cup 26 in which is provided a pellet 28 containing barium and which is capped by a tungsten-rhenium alloy cap 30. A tungsten-rhenium heater coil 32 is provided within the heater cup 26 below the barium-containing pellet 28. The cap 30 is provided with the laser-drilled holes of the embodiment of FIGS. 1 through 6 and is laser seam-welded to the cup 26. This weld assures excellent heat transfer from the heater cup to the electron emissive surface. The pellet 28 containing barium compounds is captured between the cap 30 and the heater cup 26 to provide a long-life supply of barium to the cathode surface. The molybdenum heater cup 26 permits good heat transfer from the heater coil 32 within the cup, while providing a moderately low thermal emissivity to reduce outside surface radiation losses. Further radiation loss reduction is achieved by limiting the total outside surface area of the inner subassembly 22. More specifically, the outside diameter of the cathode heater cup 26 is only 0.06 inches in diameter, thereby holding the heater cup volume to a minimum. The heater coil 32 is a coiled-coil design which incorporates a maximum amount of wire mass in the provided cup volume. The outside surface of the tungsten-rhenium heater coil 32 is coated with alumina, which is in turn, provided with a second thinner outer layer of a small particle size tungsten powder or "dark" coating, to increase the thermal emissivity of the coil surface.

The outer subassembly 24 provides a three-point suspension of the inner subassembly 22 by means of tabs 34 which are lanced from the seamless tantalum tubing that comprises the outer subassembly. These tabs 34 are resistance spot-welded to the molybdenum heater cup 26. The tantalum of which the outer subassembly is made provides a moderately poor thermal conductor which reduces the power loss to the support structure.

Suspension of the inner cathode subassembly 22 within the outer subassembly 24, by means of the tabs 34, provides a rigid mechanical support for the inner subassembly while thermally isolating the inner subassembly from the outer support. The heat transfer from the tabs 34 is in a direction of higher temperature, which is due to the close proximity of the outer support cylinder and thus reduces the tab thermal loss. Concurrently, the outer support cylinder acts as a reflective heat shield to "blanket" the inner subassembly. The inverted tab configuration of outer subassembly 24 also serves to offset the linear thermal expansion inherently produced at cathode operating temperature by expanding in a direction that is opposite to the inner cathode subassembly expansion direction. thereby reducing the cathode/G1 spacing changes which can otherwise occur.

The result of the various structurally unique characteristics of the embodiment of the invention illustrated in FIGS. 7 through 11 is primarily a significant reduction in heater power for achieving the needed heater temperature. This advantage can be observed best in the graph of FIG. 11 which shows the heater power characteristics of the thermally efficient low power design of the embodiment of FIGS. 7 through 11 as compared to a conventional single cylinder support design, such as the embodiment shown in FIGS. 1 through 6. It will be seen therein that the conventional thermal structure of the earlier embodiment requires approximately 2.8 Watts of AC power to achieve 1,000 degrees heater temperature, while in comparison, the low power, high efficiency structure of the second configuration requires only about 1.6 Watts AC to achieve the same temperature in a G1 assembly.

It will now be understood that what has been disclosed herein comprises an improved reservoir-type dispenser cathode of the type generally disclosed in the applicant's prior issued U.S. Pat. No. 4,823,044, but with a critical improvement which assures a significant uniformity in the yield and quality of the cathodes produced as described herein. More specifically, in the present invention, the porous, sintered tungsten pellet disclosed in the aforementioned prior art patent is replaced by a metal plate of uniform thickness and having a large plurality of laser-drilled pores of uniform size and at precisely selected locations. Thus, in the improvement of the present invention, the random porosity characteristics of the overlying reservoir pellet of the prior invention of the applicant are overcome by a plate having a uniform and precisely-selected number of pores, spaced equidistantly from one another, the latter providing a uniformity of electron emission which is generally not available, particularly on a consistent basis in the aforementioned prior invention of the applicant herein. This refractory metal plate described herein, in a preferred embodiment comprises a tungsten alloy, such as tungsten-rhenium, where rhenium constitutes between 10 and 50 percent of the alloy. The specific preferred embodiment for which data has been disclosed herein, comprised 75 percent tungsten and 25 percent rhenium. The laser-drilled pores or holes are 5 micrometers in diameter and are spaced 15 micrometers from one another, measured center-to-center. The plate has a thickness of 50 micrometers. The resulting cathode produces a current density of at least 25 amperes per square centimeter at 1100 degrees centigrade and provides a current density which exceeds 10 amperes per square centimeter at 950 degrees centigrade.

Also disclosed herein is a reservoir-type dispenser cathode having an improved, highly thermal efficient structure which results in the reduction of heater power needed to achieve a reduced operating temperature, while still providing high current densities. This unique thermally efficient structure comprises inner and outer subassemblies, wherein the inner subassembly is suspended within the outer subassembly by means of a three-point tab suspension configuration which thermally structure. The heater cup is provided with a barium compound containing pellet and covered with a laser drilled tungsten-rhenium alloy cap. The outer subassembly comprises a tantalum cylinder with tabs that are lanced, from the cylinder surface and angled inwardly toward the inner subassembly where they are spot-welded to the heater cup for securing the cup within the outer cylinder. The heater coil is a high mass coiled-coil configuration in which the heater wire is tungsten-rhenium and is coated with alumina and an outer layer of small particle size tungsten powder to increase thermal emissivity. The resultant thermally efficient structure provides a heater power reduction on the order of something greater than 40 percent, as compared to the more conventional structure of the applicant's earlier disclosed embodiment, such as that shown in FIGS. 1 through 6.

Those having skill in the art to which the present invention pertains, will now as a result of the applicant's teaching herein, perceive various modifications and additions which may be made to the invention. By way of example, the precise shape of the reservoir and metal plate illustrated herein, as well as the subassembly and suspension tabs of the thermally efficient embodiment may be readily altered. In addition, the materials used herein for the reservoir, the emissive material contained therein, and the overlying porous metal plate disclosed herein may be readily altered by substituting other materials of comparable refractory properties, as well as emissive characteristics in the case of the emissive material and electron-forming characteristics in the case of the overlying metal plate. By way of further example, while the cap shown in FIG. 7 has been disclosed as being a tungsten-rhenium alloy cap, such as tungsten and 25 percent rhenium, other alloys of metals are readily useable as the cap material in the present invention. By way of example, molybdenum, uncoated, or coated with a variety of materials including iridium, osmium, ruthenium, rhenium, iridium/rhenium alloy, osmium/ruthenium alloy may be substituted therefor, as well as, by way of example, an alloy containing molybdenum and rhenium metal in relative equal amounts. In addition, the cap may be made of tungsten metal or tungsten coated with the same coatings previously listed for the molybdenum example. Also suitable for use as the cap material would be rhenium metal, uncoated or coated with tungsten or iridium, as well as tungsten and rhenium in other configurations or coated with tungsten containing 5–10 percent scandium oxide. Accordingly, all such modifications and additions shall be deemed to be within the scope of the invention which shall be limited only by the claims appended hereto.

We claim:

1. A reservoir dispenser cathode having a refractory metal reservoir containing an electron emissive material and having an opening covered by a porous metal enclosure responsive to vaporization of the emissive material through the pores in the enclosure upon heating of the emissive material, a heater for activating the emissive material; the cathode further comprising:

an electron emitting metal cap of uniform thickness, having a plurality of pores of selected size and location and enclosing said reservoir; and a outer metal container having a plurality of inwardly directed protrusions for supporting said reservoir in spaced relation to said outer container for thermally isolating said reservoir.

2. A reservoir dispenser cathode recited in claim 1 wherein said protrusions are lanced form the surface of said outer container and bent inwardly toward said reservoir.

3. A reservoir dispenser cathode recited in claim 2 wherein said protrusions are welded to said reservoir.

4. A reservoir dispenser cathode recited in claim 1 wherein said outer container is made of tantalum.

5. A reservoir dispenser cathode recited in claim 1 further comprising at least one heater coil located in said reservoir adjacent said emissive material, said heater coil being coated with alumina and tungsten powder.

6. A reservoir dispenser cathode recited in claim 1 wherein said metal cap is made of tungsten.

7. A reservoir dispenser cathode recited in claim 6 wherein said tungsten cap is coated with a material taken from the group consisting of iridium, osmium, ruthenium, iridium/rhenium alloy and osmium/ruthenium alloy.

8. A reservoir dispenser cathode recited in claim 1 wherein said metal cap is made of a tungsten/rhenium alloy.

9. A reservoir dispenser cathode recited in claim 8 wherein said alloy is coated with tungsten containing scandium oxide.

10. A reservoir dispenser cathode recited in claim 8 wherein said alloy contains from 10 percent to 50 percent rhenium.

11. A reservoir dispenser cathode recited in claim 1 wherein said emissive material comprises barium.

12. A reservoir dispenser cathode recited in claim 1 wherein said emissive material comprises barium calcium aluminate.

13. A reservoir dispenser cathode recited in claim 1 wherein said emissive material comprises barium calcium aluminate and tungsten.

14. A reservoir dispenser cathode recited in claim 1 wherein said emissive material comprises a mixture of barium calcium aluminate and tungsten and wherein the tungsten comprises from 20 percent to 50 percent said mixture.

15. A reservoir dispenser cathode recited in claim 1 wherein said metal cap is made of molybdenum.

16. A reservoir dispenser cathode recited in claim 15 wherein said molybdenum cap is coated with a material taken from the group consisting of iridium, osmium, ruthenium, rhenium, iridium/rhenium alloy and osmium/ruthenium alloy.

17. A reservoir dispenser cathode recited in claim 1 wherein said metal cap is made of molybdenum/-rhenium alloy.

18. A reservoir dispenser cathode recited in claim 1 wherein said metal cap is made of rhenium.

19. A reservoir dispenser cathode recited in claim 18 wherein said rhenium metal cap is coated with a material taken from the group consisting of tungsten and iridium.

20. A improvement recited in claim 1 wherein said emissive material comprises barium calcium aluminate, tungsten, and scandium oxide.

21. A reservoir dispenser cathode comprising:

a refractory reservoir;

an electron emissive material contained within said reservoir;

said reservoir enclosing said emissive material on all but one surface of said material adjacent which there is an opening in said reservoir;

a porous cap positioned to close said reservoir opening except for pores having selected size and location on said plate; and a heater for activating said emissive material; and an outer metal container having means for at least partially enclosing said reservoir in suspended relation for thermal isolation of said reservoir.

22. A cathode recited in claim 21 wherein said pores are circular in shape, have about 5 microns diameters and are spaced about 15 microns from one another.

23. A cathode recited in claim 21 wherein said cap is about 50 microns in thickness.

24. A cathode recited in claim 21 wherein said cap comprises a metal taken from the group consisting of: molybdenum, tungsten, rhenium and an alloy thereof.

25. A cathode recited in claim 24 wherein said metal cap is coated with a material taken from the group consisting of iridium, osmium, ruthenium, rhenium, an alloy of iridium and rhenium and an alloy of osmium and ruthenium.

26. A cathode recited in claim 21 wherein said emissive material comprises barium.

* * * * *